US011066792B2

(12) United States Patent
Price, II

(10) Patent No.: US 11,066,792 B2
(45) Date of Patent: Jul. 20, 2021

(54) ASPHALT RECLAIMER WITH TOP HEATING LID

(71) Applicant: David W. Price, II, Indianapolis, IN (US)

(72) Inventor: David W. Price, II, Indianapolis, IN (US)

( * ) Notice: Subject to any disclaimer, the term of this patent is extended or adjusted under 35 U.S.C. 154(b) by 0 days.

(21) Appl. No.: 16/798,022

(22) Filed: Feb. 21, 2020

(65) Prior Publication Data

US 2021/0148065 A1 May 20, 2021

Related U.S. Application Data

(60) Provisional application No. 62/919,015, filed on Feb. 22, 2019.

(51) Int. Cl.

| | |
|---|---|
| ***E01C 23/00*** | (2006.01) |
| ***E01C 23/09*** | (2006.01) |
| ***E01C 11/00*** | (2006.01) |
| ***E01C 19/10*** | (2006.01) |
| ***E01C 23/06*** | (2006.01) |

(52) U.S. Cl.

CPC ..... *E01C 23/0973* (2013.01); *E01C 11/005* (2013.01); *E01C 19/1004* (2013.01); *E01C 23/065* (2013.01)

(58) Field of Classification Search

CPC .. E01C 11/005; E01C 19/1004; E01C 23/065; E01C 23/0973

USPC ..... 404/72, 75, 77, 79, 95, 101; 241/78, 299

See application file for complete search history.

(56) References Cited

U.S. PATENT DOCUMENTS 2,041,359 A * 5/1936 Littleford, Jr. ..... C10C 3/12 126/343.5 R
2,648,264 A * 8/1953 Green ..... E01C 23/096 404/107
2,728,336 A * 12/1955 Elgeti ..... C10C 3/12 126/343.5 A
3,266,392 A * 8/1966 Angelini ..... E01C 23/166 404/94
3,362,399 A * 1/1968 Lindenfeld ..... E01C 23/24 126/343.5 A
3,443,494 A * 5/1969 Boettler ..... E01C 23/166 404/75

(Continued)

FOREIGN PATENT DOCUMENTS

GB 2115711 * 1/1982 ..... B01F 13/10
WO WO 2004071674 * 2/2004 ..... H05B 1/00

OTHER PUBLICATIONS

KM International: Asphalt Hotbox KM4000S Undated Brochure,North Branch, MI 48461.

(Continued)

*Primary Examiner* — Raymond W Addie

(74) *Attorney, Agent, or Firm* — Overhauser Law Offices, LLC

(57) ABSTRACT

Portable asphalt reclaimer having a pivotable lid with an integral heating element, and an asphalt holding chamber containing a grate. Asphalt may be reclaimed by placing asphalt chunks on the grate, heating them from above using the heating element in the lid until asphalt falls through the holes in the grate. The asphalt may be removed through a lower door. The pivotable lid may be detachable to separately heat the ground surface to which asphalt is to be applied.

11 Claims, 2 Drawing Sheets

(56) References Cited

U.S. PATENT DOCUMENTS

| | | | | |
|---|---|---|---|---|
| 4,101,058 | A * | 7/1978 | Smith | E01C 23/166 222/274 |
| 4,477,250 | A | 10/1984 | Brashears et al. | |
| 4,623,279 | A * | 11/1986 | Smith | B05C 5/001 118/305 |
| 7,008,136 | B2 * | 3/2006 | Hill | E01C 19/174 404/101 |
| 7,077,601 | B2 | 7/2006 | Lloyd | |
| 7,240,866 | B2 | 7/2007 | Packer et al. | |
| 7,300,225 | B2 * | 11/2007 | Musil | E01C 19/00 404/101 |
| 8,840,337 | B2 * | 9/2014 | Fredrickson | E06B 7/16 404/111 |
| 9,739,021 | B1 | 8/2017 | Kuhn et al. | |
| 10,053,823 | B2 | 8/2018 | Kuhn et al. | |
| 10,428,470 | B2 * | 10/2019 | Smith | B65D 88/744 |
| 10,480,129 | B2 * | 11/2019 | Halvorson | E01C 11/005 |

OTHER PUBLICATIONS

Heat Design Equipment, Advertisement for Asphalt Mini Recycler, Sep. 2018, 1197 Union Street, Kitchener, CA N2H 6N6.

Heat Design Equipment, Undated Owner's Manaul for Asphalt Recycler, HDE MR 75, and HDE Mr150, 1197 Union Street, Kitchener, CA N2H 6N6.

Heat Design Equipment, Advertisement for RAPTOR Asphalt Recycler, HDE MR 75, and HDE Mr150, 1197 Union Street, Kitchener, CA N2H 6N6.

Kirtchener Mini REcycler, Undated Advertisement, 1197 Union Street, Kitchener, CA N2H 6N6.

KM International—KM 1000—Half ton Asphalt Hotbox Reclaimer, Undated Ad, 6561 Bernie HohlerDrive, North Branch MI 48461 dated Aug. 14, 2019.

KM International—KM 1000—Half ton Asphalt Hotbox Reclaimer, Specs dated Aug. 14, 2019.

KM International—KM 8000S—four ton Asphalt Hotbox Reclaimer, 6561 Bernie HohlerDrive, North Branch MI 48461 dated Aug. 14, 2019.

KM International—KM 8000S—four ton Asphalt Hotbox Reclaimer Specs and Features, 6561 Bernie HohlerDrive, North Branch MI 48461 dated Aug. 14, 2019.

KM International—KM T-2 Asphalt Hotbox Reclaimer, Specs and Features 6561 Bernie HohlerDrive, North Branch MI 48461 dated Aug. 14, 2019.

KM International: Asphalt Hotbox KM1000 Undated Ad, North Branch, MI 48461.

KM International—KM 4000SXPX Specification—6561 Bernie HohlerDrive, North Branch MI 48461 and undated.

KM International—KM 8000S—four ton Asphalt Hotbox Reclaimer, 6561 Bernie HohlerDrive, North Branch MI 48461 undated.

KM 8000SXPX Specification—6561 Bernie HohlerDrive, North Branch MI 48461 and undated.

KM International—KM T-2 Asphalt Reclaimer, Specs and Features 6561 Bernie HohlerDrive, North Branch MI 48461 undated.

* cited by examiner

ASPHALT RECLAIMER WITH TOP HEATING LID

CROSS REFERENCE TO RELATED APPLICATIONS

This application claims the benefit of Provisional Application No. 62/919,015 filed 22 Feb. 2019.

FIELD OF THE INVENTION

The present invention relates to devices for reclaiming previously-cured asphalt.

BACKGROUND

Asphalt chunks to be re-used or reclaimed are typically put into a metal hot box or "cookie box," then heated from the bottom to melt the asphalt for re-use. This is inefficient as much heat escapes from the top of the box. In addition heating is usually accomplished by a torch, which directs a flame to one point on the bottom of the hot box. This can cause the asphalt in the box that is immediately above the flame to burn, making it unusable and requiring extensive effort to clean the system.

SUMMARY OF THE INVENTION

A portable asphalt reclaimer has a pivotable lid with an integral heating element, and an asphalt holding chamber containing a grate. Asphalt may be reclaimed by placing asphalt chunks on the grate, heating them from above using the heating element in the lid until asphalt falls through the holes in the grate. The asphalt may be removed through a lower door. The pivotable lid may be detachable to separately heat the ground surface to which asphalt is to be applied. The systems include extendable handles having different heights on opposing side, so two devices may nested next to each other for more efficient loading.

DETAILED DESCRIPTION

Disclosed is a portable asphalt reclaimer having a fully loaded capacity of roughly 0.55 ton (dependent upon density of product) and is designed to reheat virgin or recycled asphalt products to a workable temperature. An infra-red heating element built into the underside of the lid heats asphalt. Optionally a second heating element (such as a burner or torch) may be located under the asphalt storage chamber. Both burners can be fired simultaneously or independently as needed using propane gas. The unit has self-storing handles on either side for easy transport and loading.

Figure 1:
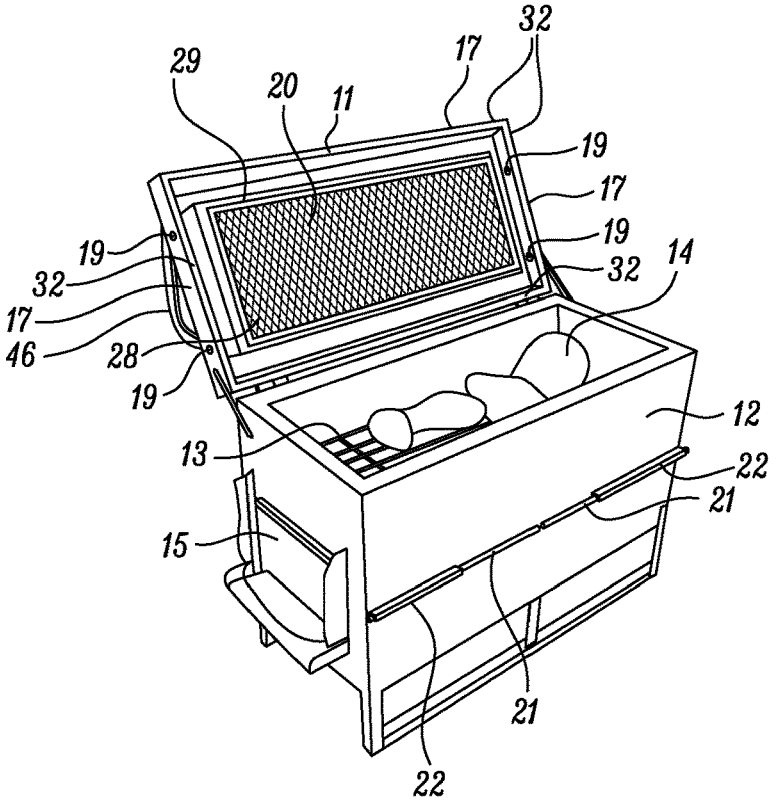
FIG. 1 is a perspective view of an asphalt reclaimer.

FIG. 1 is a perspective view of an asphalt reclaimer. It includes a pivotable lid 11 that pivots on one of the side surfaces of an asphalt holding chamber 12 having a bottom and side surfaces. An asphalt holding grate 13 has apertures within the holding chamber adapted to hold asphalt chunks 14, and allow the asphalt to drop through the grate 13 when the asphalt chunks are heated. An asphalt removal door 15 is in one of the side surfaces, located below the asphalt holding grate 13.

Top lid 11 is in an open position, but it may be pivoted to a closed position in which it lid substantially covers the asphalt holding chamber. Top lid 11 has a substantially solid upper surface 16, substantially solid side edges 17, a fuel inlet port 18, a plurality of exhaust apertures 19. Top lid 11 also includes a heating element 20 disposed between the side edges and that is in communication with the fuel inlet port.

The asphalt reclaimer may also include a pair of extendable handles 21 on opposing sides surfaces of asphalt holding chamber 12 to permit the reclaimer to be lifted an moved using the handles. Extendable handles 21 fit into channels 22 on the opposing sides of asphalt holding chamber 12. In one embodiment, the channels 22 and handles 21 are at different heights from bottom 23 of asphalt holding chamber.

In one embodiment, the heating element 20 in top lid 11 may comprise an aluminum oxide ceramic heating blanket, and be covered by an expanded metallic grid 28 to keep it in place over a 2.5" deep air tight pan. The metallic grid may be held in place by Z-channel 29 which is attached to the interior of top lid 11. The perimeter of the Z-channel may be secured by #12 self-tapping screws while fully compressing the ceramic heating blanket 20 at the perimeter to create a gasket seal. Heating element 20 may be spaced from the solid side edges of the lid to thereby permit fuel exhaust to circulate around the perimeter of heating element 20 and to exit the lid through the exhaust apertures 19.

The fuel mixing system may comprise a ¼" valve internally threaded to a piece of ⅜" pipe. A reducer fitting may be used at the end to house a ⅛" NPT propane orifice or Jet. This jet is aligned dead center to a 2" to 1" butt weld reducer pipe fitting placed inside a 6" long piece of 1.5" pipe threaded at one end. The assembly is threaded into a standard 1.5" street L pipe fitting that has in turn been threaded into a phoenix flange port of the same size welded to the underside of the burner pan.

Figure 2:
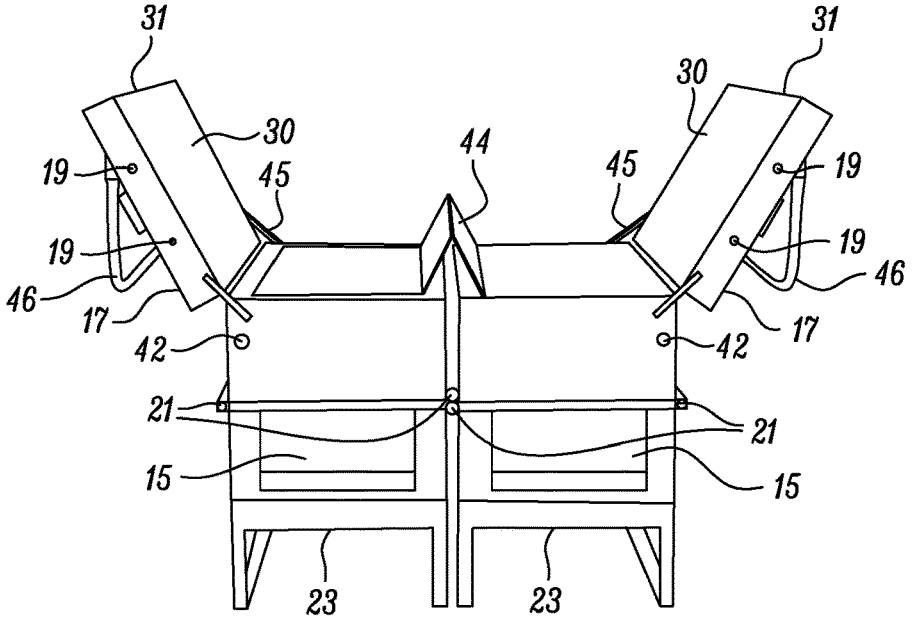
FIG. 2 is an end view of two asphalt reclaimers positioned side by side.
Figure 3:
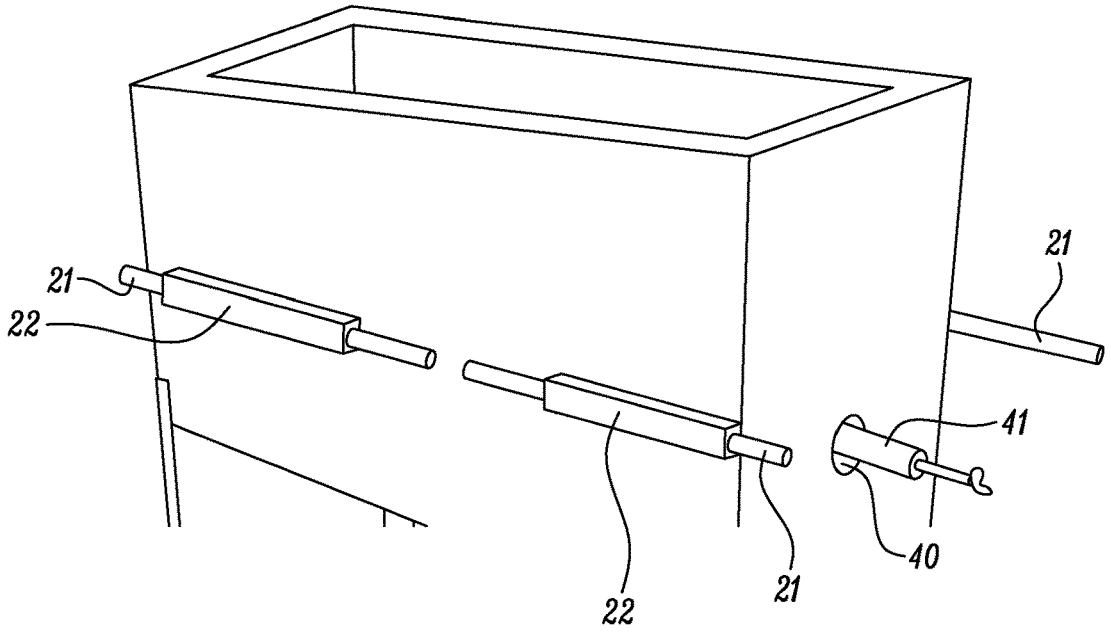
FIG. 3 shows handles in an extended position to facilitate lifting and carrying of the reclaimer.

In one embodiment, a guard or lid shield 30 may be provided that is sized to cover the heating element within the top lid. In FIG. 3, a lid shield 30 is shown removed from the lid of the left asphalt storage chamber, while the lid shield for the right asphalt storage chamber is positioned on the top lid. In FIG. 2, both top lids are shown with a lid shield 30 mounted thereon. The lid shield includes a first surface 30 sized to substantially cover heating element 20, and preferably, the edges of the lower surfaces of the 32 lid, and a second surface 32 adapted to hold the lid shield onto the lid by surrounding an edge of the lid.

In one embodiment, top lid is detachable from the asphalt holding chamber. Because the lid includes a heating element, it may be placed on the ground and used to heat pavement to be patched. This is especially in colder weather, as cold pavement does not receive and adhere to asphalt as well as warm pavement. Upon the pavement being heated, the lid may be returned to the asphalt holding chamber and used to heat asphalt therein.

Figure 4:
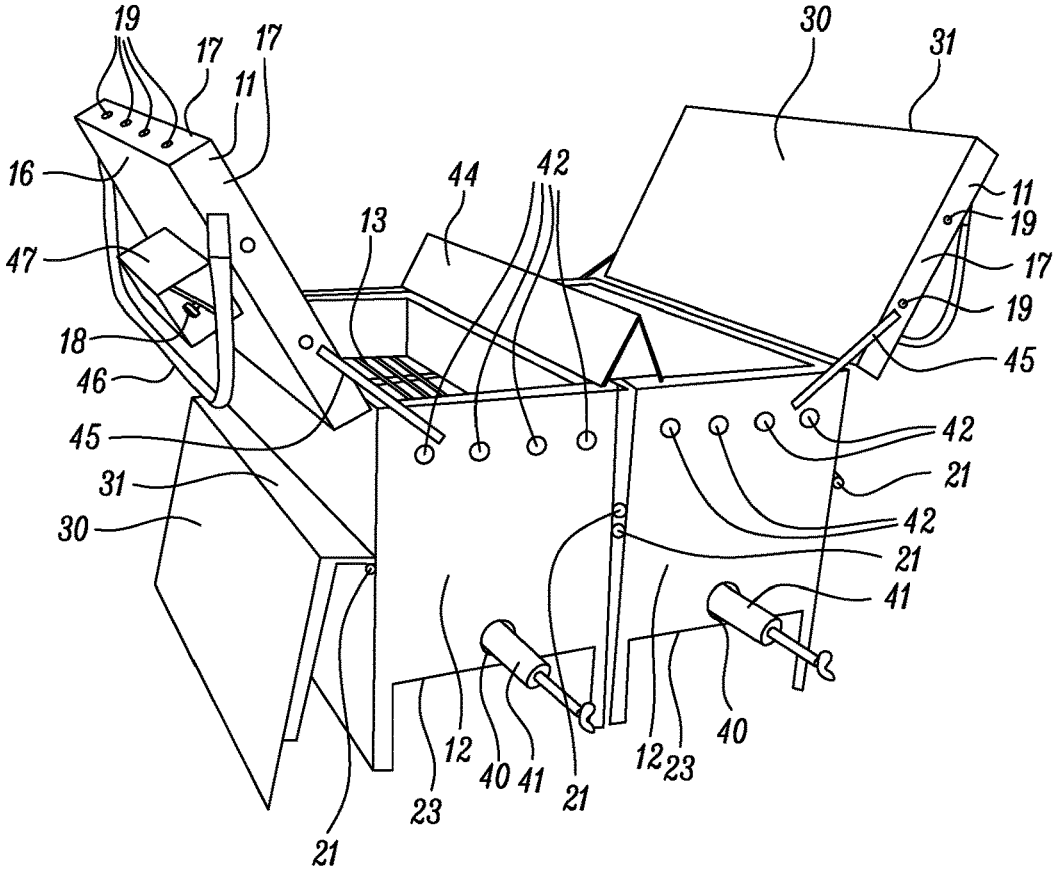
FIG. 4 shows two asphalt reclaimers positioned side by side in position to receive a load of asphalt from an overhead dispenser.

In one embodiment, the asphalt holding chamber may also be heated from the bottom. This may be done by either a heating element located below the holding chamber. This lower heating element may be of the same construction as the heating element in the lid, i.e., made of a ceramic blanket (with or without a metallic grid), or it may be a torch that introduced a flame to the bottom of the holding chamber in one spot. In either embodiment, the asphalt holding chamber may include a wall portion extending beneath the bottom of the holding chamber, and have an aperture 40 as shown in FIG. 4. A heating element 41, connectible to a fuel supply may extend through aperture 40.

In one embodiment, sides of the asphalt holding chamber may be double-walled, i.e., comprise inner and outer walls. As best shown in FIG. 1, the sides of asphalt holding chamber are thick because they have a double-wall construction. This results in a space between the inner and outer walls. The upper portions of the sides may include exhaust apertures 43. When a heating element beneath asphalt holding chamber is used as described above, exhaust from the lower heating element will circulate upward and between the inner and outer walls, thus imparting heat to the held asphalt both from the bottom and sides. This will improve even heating the asphalt, and reduce hotspots and burning of asphalt.

In normal usage, the disclosed embodiments may be used as follows. In one embodiment, two asphalt holding chambers may be placed side-by side with their pivot points for their lids positioned on the outside, as shown in FIGS. 2 and 4. Lid connecting members 45 limit the extent to which the lids may be opened. The differential heights of the handles allow the abutting handles to be positioned one right over the other, which allow the asphalt holding chambers to be positioned closer to each other. Lid shield 30 may be paced over each top lid, as shown in FIG. 2. An inverted V-shaped diverter 44 may be placed intermediate the abutting top edges.

Asphalt may be then be discharged into the asphalt holding eating chambers, either by being dropped from an overhead loader for by being shoveled in. The asphalt may either freshly manufactured asphalt, or previously cured chunks of asphalt 14. In many instances when asphalt has been applied during a prior job, asphalt is left over. While it is still warm, it can be cut into chunks. Alternatively, large pieces of cured asphalt may be made suitable for reclaiming by breaking it into chunks with a sledgehammer or power tool. Regardless of what kind of asphalt is used, the slanted orientation of the lids and diverter 44 help ensure that all asphalt is deflected into the asphalt holding chambers. When full, the lid shields and diverter may be removed, and lids closed. Fuel such as propane is provided to the heating element in the lids via fuel inlet port 18, and optionally 41, to heat the asphalt.

Ignition of the heating element may be accomplished by passing a lit conventional torch across the ceramic blanket material face as propane pressure is raised. An intermittent blue flame will move across the burner face as the blanket warms. As pressure is increased at the regulator, an orange glow will appear. The lid may be closed at any time in this process after lighting and pressure brought to a desired level. A visual check under the lid or in the shovel box area for asphalt will determine melting time. When complete, the valve to the heating element is closed and flames will diminish.

As the asphalt warms, it will break into smaller pieces and fall through the grate into the bottom of the asphalt holding chamber. Because heat is applied from above by the heating element in the lid, heated asphalt will be less likely to burn become unusable as compared to heating system that apply heat from the bottom of the holding chamber.

Once asphalt has fallen through the grate, door 15 maybe opened and the asphalt, whether fresh or reclaimed, may be shoveled out and used for paving or other purposes.

Optionally, before the above process is undertaken the surface to be paved may be heated to better receive the asphalt. In one embodiment, the lid is detachable from the asphalt holding chamber. It may be placed on the surface that is to be provided with new asphalt. The fuel may be applied to the heating element to heat the surface. Then, lid may be removed from the hard surface and re-mounted to the heating chamber. Asphalt may then be heated and applied as described above.

The present system is suitable for heating asphalt to repair potholes or otherwise used to make asphalt repairs in any season or temperature. It allows a user to work regardless of whether there is an operating asphalt plant nearly by utilizing bunked up material or in conjunction with a retail facility by filling the box with purchased material and maintaining workable temperatures throughout the workday. Excess material may be formed into "cookies" or chunks and left to cool for reclaiming another day. In the disclosed configuration, heating times are shortened and fuel consumption is cut.

The lid may be opened and reloaded the device may be reloaded with cold asphalt pieces.

The disclosed embodiment may also be used as a heated storage box by simply opening the valve of the lit conventional bottom burner to the desired flame thus maintaining proper material temperature.

One embodiment may use skid type angle iron legs that stand 9" tall. The pipe handles 21 stow inward on either side. A lid securing device is above may be provided. Lid 11 may have vent holes 19 that are ¾" diameter. The top of lid 11 may house a propane valve, jet and Ventura feeding the infra-red ceramic blanket heating element. Arching bar 46 on top is the safety handle for lid 11. The lid may include a shield for the propane assembly for safety and reliability. Lid retainer member 45 holds lid 11 safely at an open angle.

Those of skill in the art will understand that various details of the invention may be changed without departing from the spirit and scope of the invention. Furthermore, the foregoing description is for illustration only, and not for the purpose of limitation, the invention being defined by the claims.

While the invention has been illustrated and described in detail in the foregoing drawings and description, the same is to be considered as illustrative and not restrictive in character, it being understood that only illustrative embodiments thereof have been show and described and that all changes and modifications that are within the scope of the following claims are desired to be protected.

All references cited in this specification are incorporated herein by reference to the extent that they supplement, explain, provide a background for or teach methodology or techniques employed herein.

What is claimed is:

1. An asphalt reclaimer with a pivoting heating lid comprising:

an asphalt holding chamber having a bottom and side surfaces, an asphalt holding grate having apertures within the holding chamber adapted to hold asphalt chunks, and allow the asphalt to drop through the grate when the asphalt chunks are heated, an asphalt removal door in one of the side surfaces, located below the asphalt holding grate, a top lid pivotally connected to one of the side surfaces, the top lid being movable between a closed position in which the lid substantially covers the asphalt holding chamber, and an open position in which the top lid does not cover the asphalt holding chamber, the top lid comprising:

a substantially solid upper surface, substantially solid side edges a fuel inlet port, a plurality of exhaust apertures, a heating element disposed between the side edges and that is in communication with the fuel inlet port.

2. The asphalt reclaimer with a pivoting heating lid of claim 1 wherein the heating element comprises a ceramic blanket.

3. The asphalt reclaimer with a pivoting heating lid of claim 1, wherein the heating element is spaced from the solid side edges of the lid to thereby permit fuel exhaust to circulate around the perimeter of the heating element and to exit the lid through the exhaust apertures.

4. The asphalt reclaimer with a pivoting heating lid of claim 1, wherein the edges of the lid have lower surfaces, and further comprising a removable lid shield having a first surface sized to substantially cover the heating element of the lid, and a second surface adapted to hold the lid shield onto the lid by surrounding an edge of the lid.

5. The asphalt reclaimer with a pivoting heating lid of claim 1 wherein the lid is detachable from the asphalt holding chamber.

6. The asphalt reclaimer with a pivoting heating lid of claim 1 further comprising:

a pair of extendable handles on opposing sides surfaces to permit the reclaimer to be lifted using the handles.

7. The asphalt reclaimer with a pivoting heating lid of claim 6 wherein the asphalt holding chamber has a bottom and the extendable handles are spaced at different heights from the bottom of the asphalt holding chamber.

8. The asphalt reclaimer with a pivoting heating lid of claim 1 wherein

One side of the holding chamber includes a portion extending beneath the bottom of the holding chamber, the portion having an aperture, and further comprising a heating element passing through the aperture of the portion to heat the holding chamber.

9. The asphalt reclaimer with a pivoting heating lid of claim 8 wherein the sides of the asphalt holding chamber comprise inner and outer walls, and wherein the outer walls have exhaust apertures.

10. A method of patching a hard surface with asphalt comprising:

providing an asphalt reclaimer of claim 1, placing a guard over the heating element of the lid, putting asphalt in the asphalt holding chamber and onto the grate, removing the guard from the lid, closing the lid, heating the heating element of the lid until asphalt falls through the grate into the bottom of the asphalt holding chamber, opening the asphalt removal door, removing heated asphalt from the asphalt holding chamber through the removal door, and applying the asphalt to the hard surface.

11. The method of patching a hard surface with asphalt comprising the method of claim 10, and further comprising, before the step of heating the heating element until asphalt falls through the grate into the bottom of the asphalt holding chamber, the steps of removing the lid from the asphalt reclaimer, placing the lid on the hard surface so the heating element is above the hard surface, heating the heating element to thereby heat the hard surface, and removing the lid from the hard surface and pivotably mounting it on the heating chamber, and closing the lid.

* * * * *